US012396576B2

(12) United States Patent
Cheng et al.

(10) Patent No.: US 12,396,576 B2
(45) Date of Patent: Aug. 26, 2025

(54) FOLDING DISPLAY RACK

(71) Applicant: CHANGZHOU LINTEL DISPLAY CO., LTD., Jiangsu (CN)

(72) Inventors: Xiaofeng Cheng, Jiangsu (CN); Zhantao Liang, Jiangsu (CN); Hanjun Jiang, Jiangsu (CN)

(73) Assignee: CHANGZHOU LINTEL DISPLAY CO., LTD., Jiangsu (CN)

( * ) Notice: Subject to any disclaimer, the term of this patent is extended or adjusted under 35 U.S.C. 154(b) by 0 days.

(21) Appl. No.: 18/566,674

(22) PCT Filed: Mar. 10, 2023

(86) PCT No.: PCT/CN2023/080676
§ 371 (c)(1),
(2) Date: Dec. 4, 2023

(87) PCT Pub. No.: WO2024/082524
PCT Pub. Date: Apr. 25, 2024

(65) Prior Publication Data

US 2025/0204703 A1 Jun. 26, 2025

(30) Foreign Application Priority Data

Dec. 7, 2022 (CN) ..... 202211564212.3

(51) Int. Cl.
*A47F 5/10* (2006.01)
*A47B 43/00* (2006.01)

(52) U.S. Cl.
CPC ..... *A47F 5/10* (2013.01); *A47B 43/00* (2013.01)

(58) Field of Classification Search
CPC ..... A47F 5/10; A47F 5/13; A47B 43/00
See application file for complete search history.

(56) References Cited

U.S. PATENT DOCUMENTS 1,065,402 A * 6/1913 Stearns ..... D06C 3/00 160/230
1,626,507 A * 4/1927 Camper ..... D06F 57/08 211/182

(Continued)

FOREIGN PATENT DOCUMENTS

CN 213634891 7/2021
CN 113820915 12/2021

(Continued)

OTHER PUBLICATIONS

"International Search Report (Form PCT/ISA/210) of PCT/CN2023/080676", mailed on Sep. 1, 2023, pp. 1-5.

*Primary Examiner* — Stanton L Krycinski
(74) *Attorney, Agent, or Firm* — JCIPRNET

(57) ABSTRACT

A folding display rack includes a corner connection piece and an intermediate connection piece, where the corner connection piece includes an upper corner connection piece and a lower corner connection piece; two ends of the long frames are connected to an upper short frame and a lower short frame respectively through the upper corner connection piece and the lower corner connection piece; the intermediate connection piece is located at the middle position of each of the long frames and divides the long frame into two parts; the long frame is can be folded in a direction from the middle to the inner side of the display frame through the intermediate connection piece; and the long frames on two sides can be folded in half from the middle through the corner connection piece and then are staggered, folded and stored on the short frame on the lower side.

9 Claims, 12 Drawing Sheets

(56) References Cited

U.S. PATENT DOCUMENTS 3,583,466 A * 6/1971 Dreyer ..... G03B 21/58 160/381
3,830,374 A * 8/1974 Kassimir ..... A47F 5/103 211/1
4,271,766 A * 6/1981 Schmiedeler ..... A47B 43/02 108/115
4,715,502 A * 12/1987 Salmon ..... H04Q 1/09 211/175
4,805,783 A * 2/1989 Mayer ..... A47F 5/0846 D25/124
5,163,262 A * 11/1992 Adams ..... B64G 99/00 52/645
5,253,763 A * 10/1993 Kirkley ..... B65D 19/16 217/15
5,607,070 A * 3/1997 Hellyer ..... A47F 5/0846 211/187
5,890,607 A * 4/1999 Maglione ..... A47F 5/0846 108/108
5,918,750 A * 7/1999 Jackson ..... A47F 5/0807 108/108
6,009,651 A * 1/2000 Current ..... G09F 15/0068 40/607.1
6,105,292 A * 8/2000 Current ..... G09F 15/0068 40/607.04
6,116,326 A * 9/2000 Domina ..... E04B 2/7422 160/351
6,702,125 B2 * 3/2004 Hartel ..... H04Q 1/06 211/175
D602,713 S * 10/2009 Stukenberg ..... D6/681.1
8,045,264 B2 * 10/2011 Elliott ..... G03B 21/58 359/443
8,342,347 B2 * 1/2013 Hay ..... B65D 11/1866 312/258
8,807,356 B2 * 8/2014 Weigand ..... A47F 5/10 211/183
8,959,813 B2 * 2/2015 Denby ..... G09F 15/0068 40/606.03
9,198,508 B1 * 12/2015 Kufel ..... A47B 47/024
9,364,104 B1 * 6/2016 Wood ..... A47G 25/06
9,370,277 B2 * 6/2016 Weaver ..... A47J 47/16
10,172,749 B2 * 1/2019 Richardson ..... A61G 1/013
10,231,538 B2 * 3/2019 Zelek ..... A47F 5/10
11,408,224 B2 * 8/2022 De La Porte ..... E06B 9/0692
11,828,443 B2 * 11/2023 Cheng ..... F21V 21/06
2005/0200951 A1 * 9/2005 Redmon ..... G09F 19/18 359/443
2007/0201844 A1 8/2007 Ealer
2010/0079860 A1 * 4/2010 Unno ..... G03B 21/58 359/443
2010/0238544 A1 9/2010 Elliott et al.
2011/0220604 A1 * 9/2011 Ma ..... A47B 43/00 211/198
2012/0241401 A1 * 9/2012 Galey ..... A47F 5/0815 211/189
2020/0288864 A1 * 9/2020 Jensen ..... A47B 73/00

FOREIGN PATENT DOCUMENTS

CN 215271783 12/2021
CN 114236961 3/2022
CN 216353185 4/2022
CN 217214074 8/2022
CN 115641789 1/2023
DE 29515633 U1 * 1/1996
DE 102006040306 A1 * 5/2007 ..... A47B 3/002
DE 202021002287 7/2021
JP H11219140 8/1999
KR 20090008466 8/2009
TW M578115 5/2019

* cited by examiner

FOLDING DISPLAY RACK

CROSS-REFERENCE TO RELATED APPLICATION

This application is a 371 of international application of PCT application serial no. PCT/CN2023/080676, filed on Mar. 10, 2023 which claims the priority benefit of China application no. 202211564212.3, filed on Dec. 7, 2022. The entirety of each of the above mentioned patent applications is hereby incorporated by reference herein and made a part of this specification.

TECHNICAL FIELD

The present invention belongs to the field of display and exhibition, and particularly relates to a folding display rack that is expandable longitudinally and foldable longitudinally.

TECHNICAL BACKGROUND

With the development of society, it is more and more popular for enterprises to set up various exhibition and display frames flexibly and rapidly for the display and publicity of goods in meetings, exhibitions, displays and other occasions. An exhibition cloth frame and an exhibition light box are exhibition appliances that are widely used. The main structure is a combination of a display frame, canvas and light, which can be temporarily built to form a large exhibition screen, or can be independently placed to form a small publicity column. The present application belongs to an independent display rack structure.

An existing independent display rack structure is a rectangular frame which is set up on site through profiles, connection pieces, locksets and the like. On one hand, due to different lengths and specifications of the profiles, it is inconvenient to store and transport the profiles uniformly; and on the other hand, when the display frame is set up, due to the cumbersome structure, many connection parts are required, thereby causing time-consuming, laborious and low-efficiency on-site construction. Furthermore, in case of many connection parts, missing or confusion can easily occur, which affects the reuse. Therefore, the folding display rack becomes the development trend.

At present, the folding display racks appearing in the market sporadically also have the problems of cumbersome structure, high manufacturing cost, complicated combined construction and low stability. For example, the US202111603921.3 forms a foldable structure in which a vertical rod achieves a structure of turning, folding in half and then folding inward through a first connecting frame, a second rotating structure, a second rotating structure and other structures. In this way, a small storage structure is achieved by twice folding in half. However, after unfolding, fixation can be achieved only by cooperation of various fixing assemblies. Therefore, the market demand cannot be met, and the folding storage and the stretching unfolding of the overall display rack cannot be achieved.

In addition, for the independent display rack, there is currently no structural form that can realize the longitudinal or transverse extension of the display frame in the current market, so the use requirements in some occasions cannot be met.

SUMMARY OF THE INVENTION

To overcome the above defects, the present invention provides a folding display rack with a simple structure and convenient construction, which is convenient in transportation. Furthermore, assembly of frames are not required for a customer, and the size of the display rack is flexible and changeable.

To achieve the above objective, the technical solution of the present invention is as follows:

a folding display rack includes a display frame, where the display frame includes a pair of short frames and at least one pair of long frames. The folding display rack further includes:

a corner connection piece, including an upper corner connection piece and a lower corner connection piece, where two ends of the long frames are connected to an upper short frame and a lower short frame respectively through the upper corner connection piece and the lower corner connection piece; and an intermediate connection piece, where the intermediate connection piece is located at a middle position of each of the long frames, and divides the long frame into two parts, the long frame can be folded in a direction from the middle to the inner side of the display frame through the intermediate connecting piece, and the long frames on two sides can be folded in half from the middle through the corner connection piece and then is staggered, folded and stored on a short frame on the lower side.

As a preferred embodiment of this embodiment: the lower corner connection piece includes a lower corner body, a lower pin shaft and a lower rotation piece; the lower rotation piece is connected to the lower corner body through the lower pin shaft and is rotatable around the lower pin shaft towards an inner side of the display frame; a movable end of the lower rotation piece is in inserting connection with the long frame; with one end of the lower pin shaft as a reference point, the other end of the lower pin shaft inclines downwards and towards the inner side of the display frame and is insertion-mounted at a connecting end of the corner body and the rotation piece; the upper corner connection piece includes an upper corner body, an upper pin shaft and an upper rotation piece; and the upper corner connection piece and the lower corner connection piece are mounted at the upper and lower ends of the long frame respectively to form an axisymmetric structure.

According to the present invention, a rotating shaft is arranged obliquely to drive the long frames connected thereto to be obliquely folded around the rotating shaft in the corresponding direction, so that the long frames on two sides can be staggered and stored after being folded in half.

As a further improvement of the present invention: the downward inclination angle of the lower pin shaft is the same as the inclination angle towards the inner side of the display frame, and it is ensured that the folded long frames and the short frames are parallel with each other through the angle complementation.

As a preferred embodiment of the present invention: the intermediate connection piece includes an intermediate body, and half-folding pieces hinged to two ends of the intermediate body respectively through a pin; and the half-folding pieces are rotatable around the pin towards an outer side of the display frame.

As a further improvement of the present invention: to make the overall frame more stable, the folding display rack further includes a supporting rod, where two ends of the supporting rod are in clamping connection with the intermediate body for limiting the folding after the long frames are unfolded.

To reduce parts such as fixed connection pieces and constructing connection pieces, the present invention improves the frame profile: two inserting holes are formed in end faces of inner sides of the short frames and the long frames, and a mounting groove is formed between the two inserting holes.

As a further improvement of the present invention: a lighting assembly is arranged in the mounting groove, so that the lighting effect during exhibition is further increased to render the atmosphere of the scene.

To cooperate with the improvement of the profile and facilitate the on-site installment, a light guide plate and a light strip may be selected for the lighting assembly, as long as they can be fixed in the mounting groove.

To longitudinally extend the display frame and achieve the folding objective, the folding display frame is further provided with the intermediate reverse connection pieces for connecting two or more pairs of long frames, where each of the intermediate reverse connection pieces includes an intermediate reverse body, and reverse rotation pieces hinged to two ends of the intermediate reverse body respectively through a positioning pin; the reverse rotation pieces are rotatable around the positioning pin towards the inner side of the display frame; one end of each of the adjacent long frames on the same side is in inserting connection with the reverse rotation pieces, respectively; and the intermediate reverse connection pieces at the corresponding positions of the left side and the right side are connected through the supporting rod for limiting the rotation of the intermediate reverse connection pieces after the display frame is unfolded.

To ensure that the folded frames form the best parallel position to avoid friction damage to each part, the height of the intermediate body is matched with the height of the long frame folded in half.

To further facilitate the electrical connection of the lighting assemblies mounted in the mounting groove of the long frame and on the two sides of the intermediate connection piece, a conductive terminal is arranged on one side of the lighting assembly close to the intermediate connection piece; a conductive column extending towards one side of the intermediate connection piece and exceeding the conductive terminal is arranged in the conductive terminal through a spring; a conductive column I penetrating through the intermediate body is fixed on the intermediate body of the intermediate connection piece and at a position corresponding to the conductive column; and after the display frame is unfolded, the lighting assemblies on two sides of the intermediate connection piece are electrically connected in series through the contact connection of the conductive column and the conductive column I.

In the present invention, when the frame is wide enough, the folding display rack may be placed directly on site, of course, a base anchor may be fixed at the bottom of the lower-side frame, thereby improving the stability of the display frame.

The present invention has the following advantages:

1. According to the present invention, the structural design is ingenious. Through the design of the corner connection pieces and the long frames, the overall structure of the display rack directly forms a structure folded for one or more times, so that the product volume is greatly reduced and transportation is facilitated.
2. According to the present invention, the structure is stable. Through the cooperated design of the supporting rod and the long frames, the problem about the structural stability after the display frame is unfolded is solved, and convenience and reliability are achieved.
3. The folding display rack is simple in structure and low in manufacturing cost, can realize overall folding and overall stretching unfolding, does not require on-site assembly and other auxiliary tools, and can meet the use requirement of customers on on-site rapid construction anytime and anywhere, so that the installment efficiency is greatly improved, and convenience and rapidness are achieved.
4. According to the present invention, the staggered folding function is achieved through the design of the corner connection pieces and the long frames, thereby ensuring that the lengths of the frames on two sides are not limited by the length of the lower frame, and achieving the flexibly changeable size of the display frame.
5. According to the present invention, the number of the long frames can be increased by the intermediate reverse connection piece, so that the longitudinal height of the frame is extended, and the use efficiency of the display frame is improved. Meanwhile, through the design of the frame structure, the lighting assembly can be directly added to highlight the exhibition and display effect.

DETAILED DESCRIPTION OF EMBODIMENTS

The technical solutions in the embodiments of the present invention are described below clearly and completely with reference to the accompanying drawings in the embodiments of the present invention. Apparently, the described embodiments are only some embodiments of the present invention. Based on the embodiments of the present invention, all other embodiments obtained by those of ordinary skill in the art without creative efforts should be included in the protection scope of the present invention.

Embodiment 1

Figure 1:
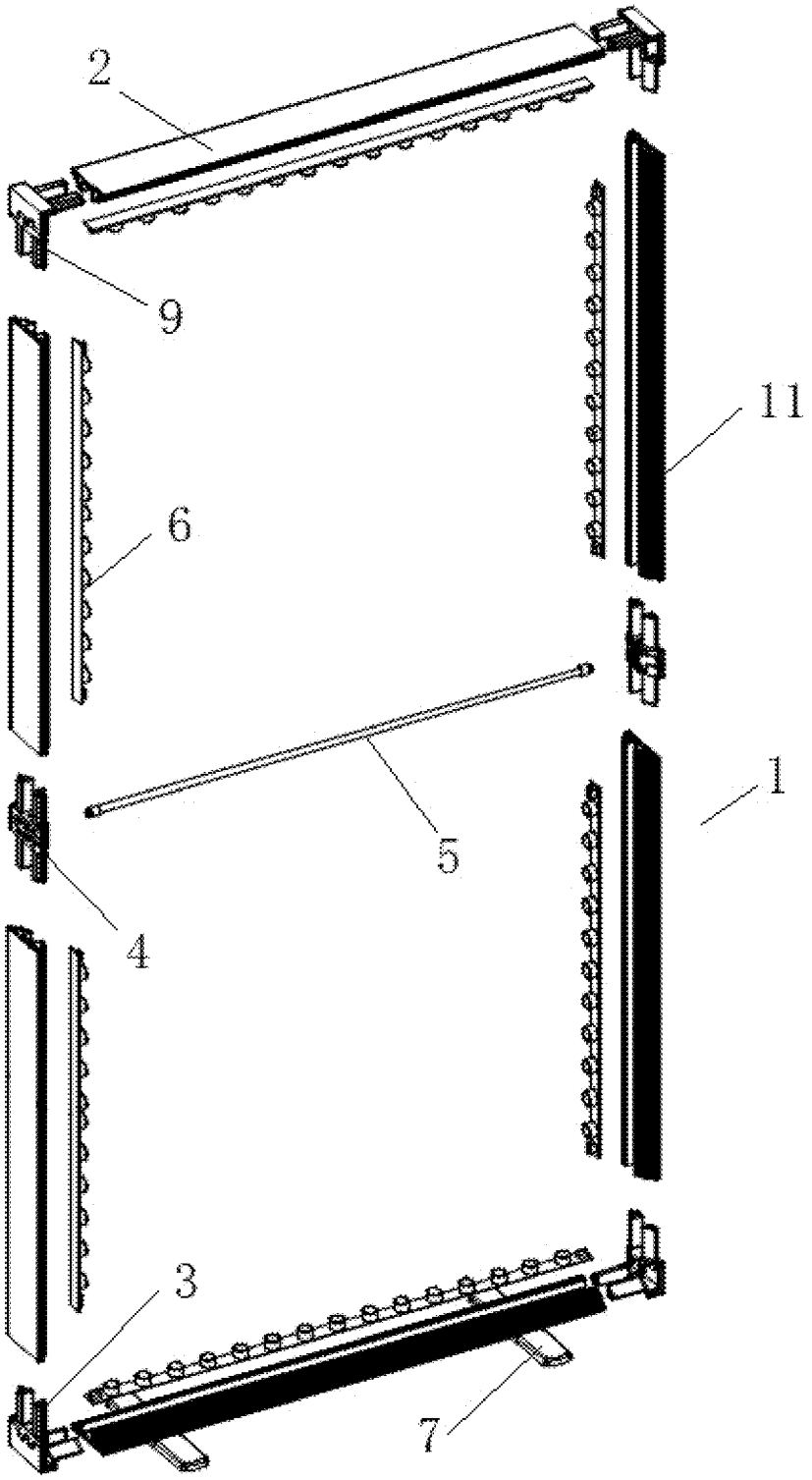
FIG. 1 is an exploded structural diagram of a folding display rack according to Embodiment 1.

As shown in FIG. 1, this embodiment relates to a folding display rack, including a display frame, a base anchor 7 and a supporting rod 5, where the display frame is of a rectangular structure and includes a pair of short frames 2 and a pair of long frames 1. Each of the long frames includes two long frame sections 11 with the same length, and an intermediate connection piece 4. As shown in FIG. 1: a corner connection piece includes an upper corner connection piece 9 and a lower corner connection piece 3. An upper short frame is hingedly connected to one end of the long frame through the upper corner connection piece 9, and a lower short frame is hingedly connected to one end of the long frame through the lower corner connection piece 3.

Figure 2:
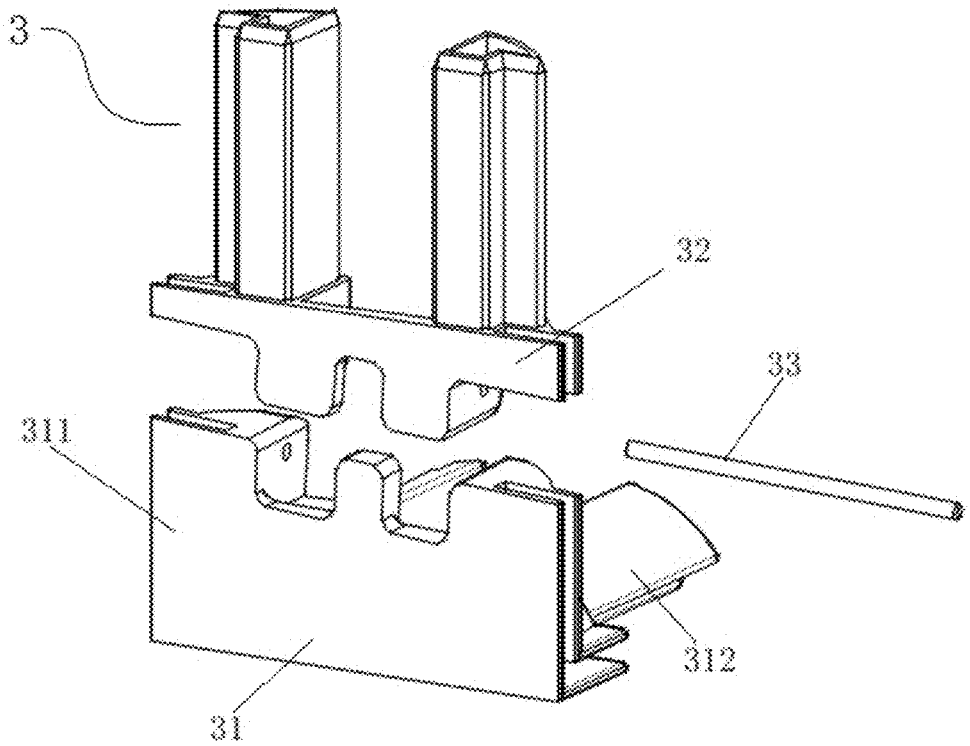
FIG. 2 is a three-dimensional structural diagram of a lower corner connection piece.
Figure 3:
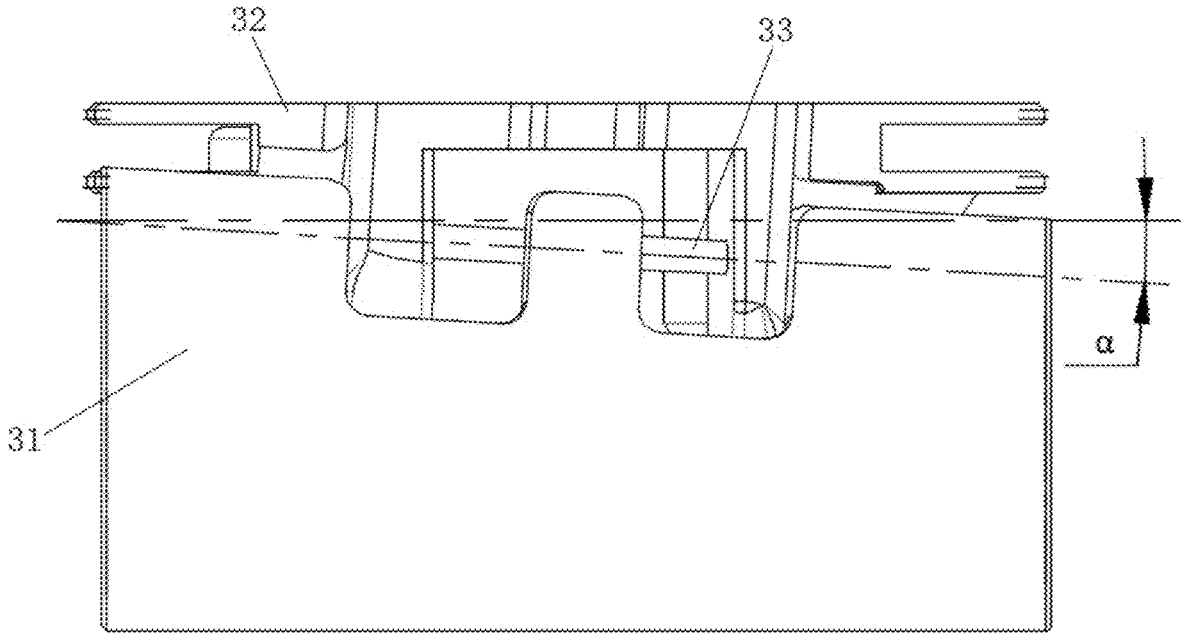
FIG. 3 is a left view after a lower corner connection piece is folded in half.
Figure 4:
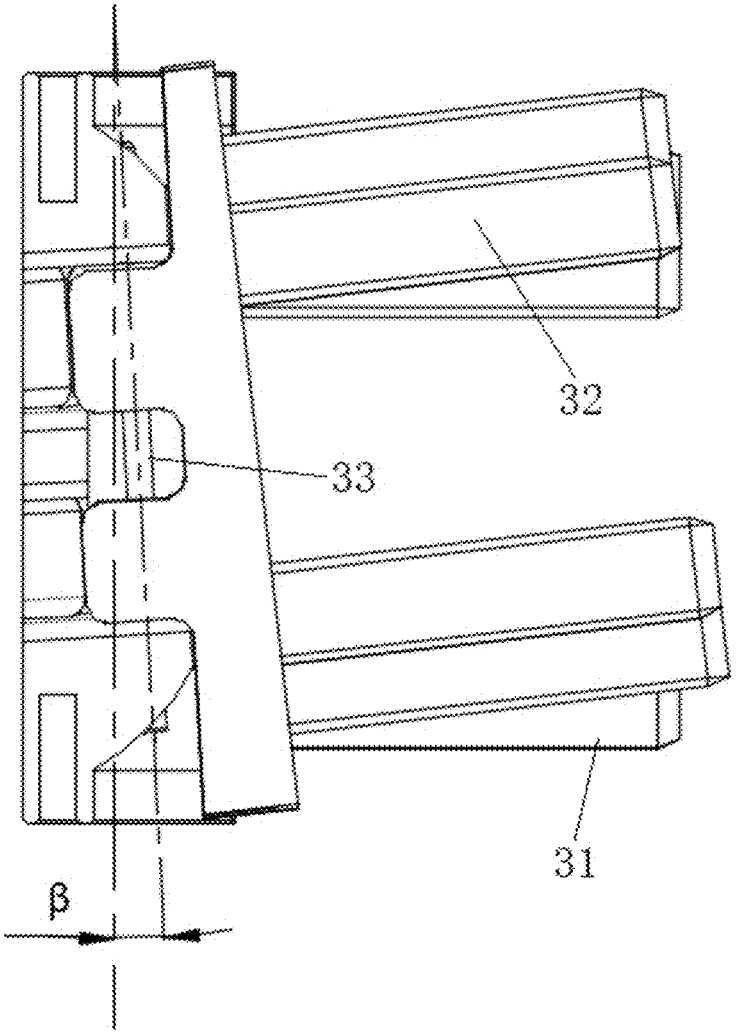
FIG. 4 is a top view after a lower corner connection piece is folded in half.

As shown in FIG. 2 to FIG. 4: the lower corner connection piece 3 includes a lower corner body 31, a lower rotation piece 32 and a lower pin shaft 33. In this embodiment, the lower corner body 31 is provided with a connecting end face I and a connecting end face II 311 which are connected in a 90-degree angle, where an insertion-connecting boss 312 is directly formed on the connecting end face I and used for inserting connection with the short frame in a matched manner; the connecting end face II is hingedly connected to the lower rotation piece 32 through the lower pin shaft 33; and an insertion-connecting boss is also formed at a movable end of the lower rotation piece 32 and is in inserting connection with the long frame section 11, so that the lower rotation piece 32 can drive the connected long frame section 11 to rotate around the lower pin shaft 33 by 90 degrees towards the inner side of the display frame.

Figure 5:
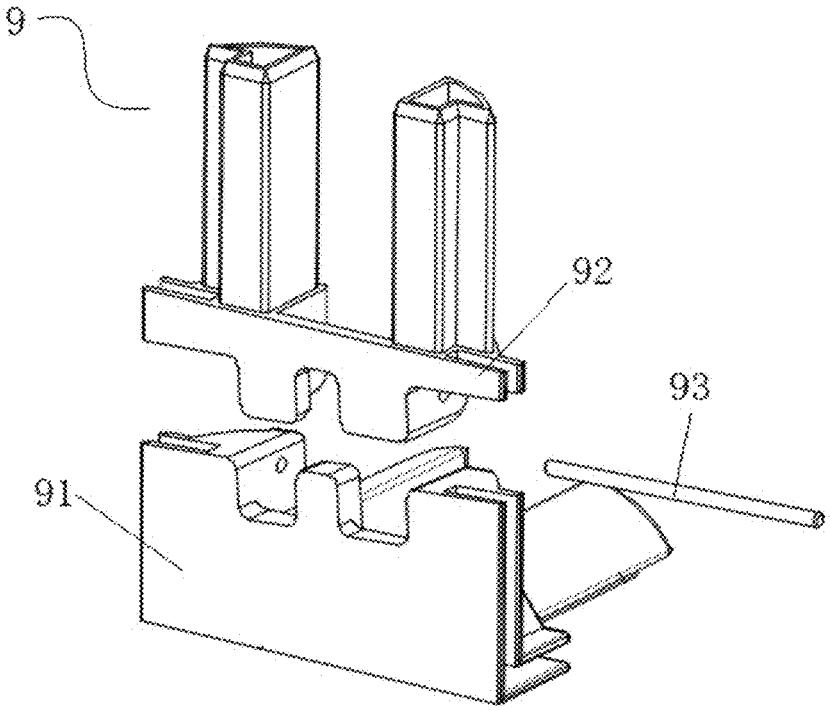
FIG. 5 is a three-dimensional structural diagram of an upper corner connection piece.
Figure 7:
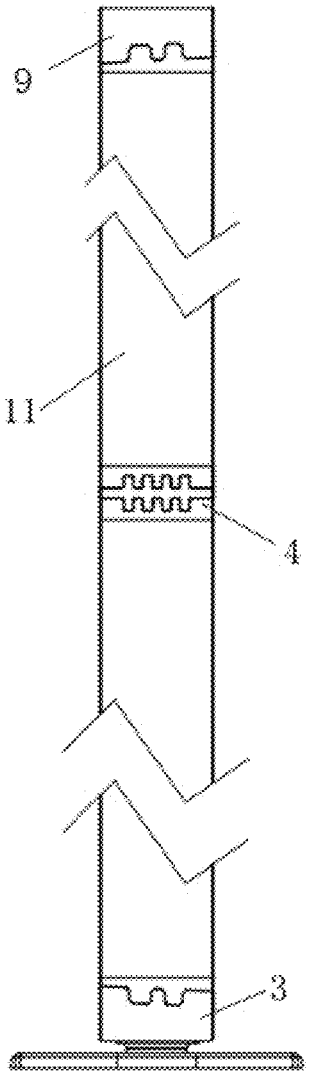
FIG. 7 is a left view of FIG. 1.

As shown in FIG. 2 and FIG. 5: the upper corner connection piece 9 includes an upper corner body 91, an upper rotation piece 92 and an upper pin shaft 93, where the upper corner connection piece 9 has a structure similar to the lower corner connection piece 3, with the only difference in the inclination directions of the upper pin shaft 93 and the lower pin shaft 33, thereby ensuring that the upper long frame and the lower long frame are inclined and folded towards the same side. As shown in FIG. 7: the upper corner connection piece 9 and the lower corner connection piece 3 are respectively mounted on the upper and lower sides of the long frames to from an axisymmetric structure.

In this embodiment, the design of the inclination angle is described in detail by taking the lower corner connection piece as an example. As shown in FIG. 2 to FIG. 4: an upper end face of the connecting end face II 311 of the lower corner connection piece 3 has an inclined docking structure with a high left part and a low right part. With the left end as a reference point, the lower pin shaft is inclined downwards to the right end and towards the inner side of the display frame and is insertion-mounted on the connecting end face II 311. An included angle $\alpha$ is formed between a straight line where the lower pin shaft is located and a horizontal plane; an included angle $\beta$ is formed between the straight line where the lower pin shaft is located and a vertical plane; in this embodiment, the included angle $\alpha$ is the same as the included angle $\beta$, so that a structure with mutually compensated inclined angles is formed, thereby ensuring that the long frames folded obliquely and the short frames can be parallel with each other. To reduce the folded volume as much as possible, the included angle should be less than 10 degrees, and both the included angle $\alpha$ and the included angle $\beta$ in this embodiment are 3.5 degrees. For the long frames to be erected uprightly after the folding frame is unfolded, a docking surface on the lower rotation piece that is docked with the connecting end face II 311 of the lower corner body is correspondingly designed as a matched structure with a narrow left part and a wide right part, and the insertion-connecting boss formed by the movable end of the lower rotation piece 32 is in forward vertical inserting connection with the long frame 1. In this way, the lower rotation piece 32 can drive the long frame sections 11 to be folded obliquely in the corresponding direction, and the unfolded long frames can be erected normally.

Figure 6:
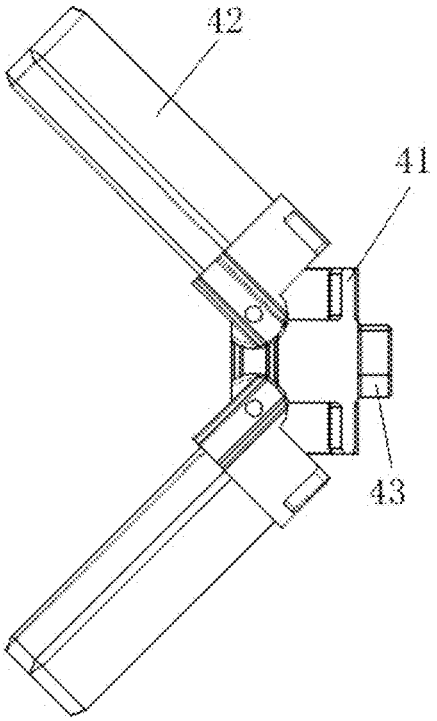
FIG. 6 is a structural diagram of an intermediate connection piece.

As shown in FIG. 6: the intermediate connection piece 4 includes an intermediate body 41, and half-folding pieces 42 hinged with two ends of the intermediate body through a pin. The half-folding pieces can rotate around the pin shaft towards an outer side of the display frame. The two long frame sections 11 are in inserting connection with the two half-folding pieces 42, respectively, thereby achieving inward folding of the long frames. The intermediate body of the intermediate connection piece is provided with a clamping end 43 for fixed connection between the unfolded display frame and the supporting rod 5.

Figure 9:
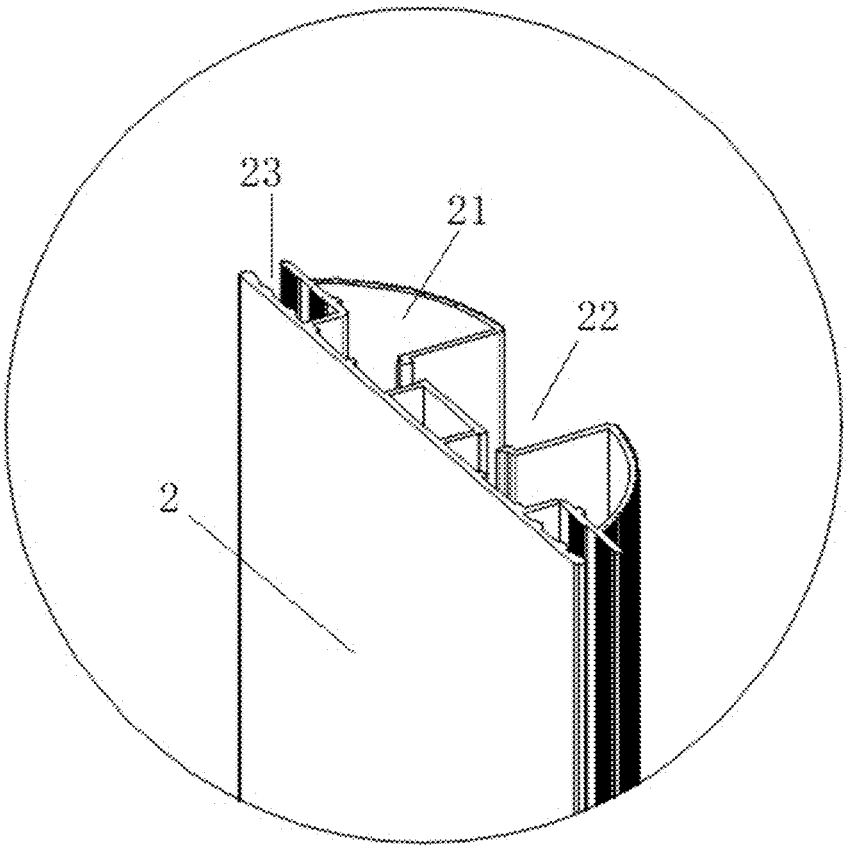
FIG. 9 is a structural schematic diagram of a short frame or a long frame in a display frame.

As shown in FIG. 9, in this embodiment, the short frames 2 and the long frames 1 have the same sectional structure, with the only difference in lengths. In this embodiment, the structure is described by taking the short frame 2 as an example. Two inserting holes 21 are formed in an end face of an inner side of the short frame and used for inserting connection with the intermediate connection piece 4, the corner connection piece and the intermediate reverse connection piece 8. A mounting groove 22 is formed between the two inserting holes and used for mounting a lighting assembly 6. Clamping grooves 23 are formed in the side surfaces of the two sides of the short frame 2 and used for fixed connection with the periphery of canvas.

As shown in FIG. 1: the folding rack is provided with a base anchor 7, and the short frame is fixedly connected on the base anchor 7.

Figure 8:
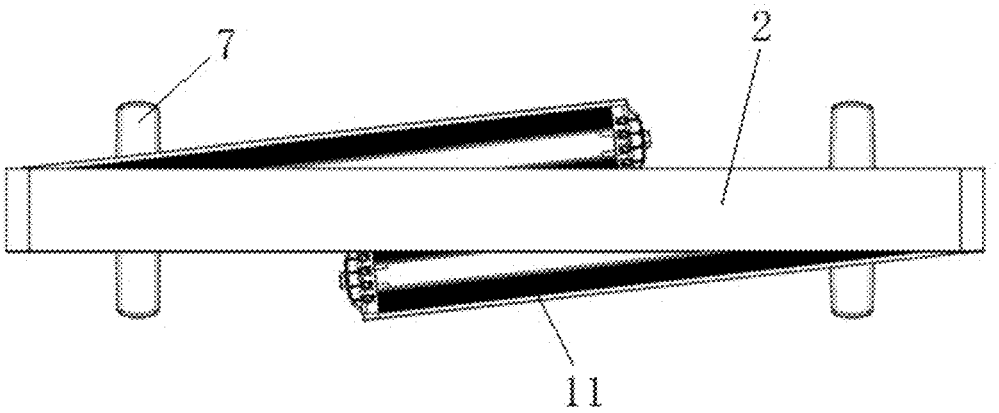
FIG. 8 is a structural diagram of final folding of a folding display rack.

As shown in FIG. 6, FIG. 7 and FIG. 8: the hinged structure of the intermediate connection piece 4 adopts a normal design, and four corners of the folding rack are all special corner connection pieces designed by the present application. By use of the axisymmetric upper and lower corner connection pieces, the long frame 1 on the left side is inclined and folded from the middle to a rear side of the display frame, and similarly, the long frame on the right side is inclined and folded from the middle to a front side of the display frame, so that the long frames on the two sides are folded to form a non-overlapping structure in a front-and-back staggered manner, thereby overcoming the limitation by the transverse length of the short frame.

As shown in FIG. 6: in this embodiment, a height of the intermediate body 41 is matched with a height of the long frame 1 folded in half. Finally, the folding frame can be folded into a minimum structure.

It can be seen from this embodiment and the figures that the folding rack of the present application can be folded, unfolded and fixedly mounted without any assistance tools and without other matching parts, and thus installation and fixing is very fast and convenient.

In this embodiment, the supporting rod is used to limit and stabilize the folding rack structure. Of course, the supporting rod may not be used in the present application. For example, the damping design or clamping design or tight fit design is added on the basis that the intermediate body of the intermediate connection piece 4 is hinged with the half-folding piece, so as to ensure the relative stability in position between the unfolded intermediate body and the half-folding piece. Similarly, the upper and lower corner connection pieces may adopt the above structure to ensure the position stability of the unfolded long frames. Finally, the folding rack is further stabilized by clamping the canvas. The damping design or clamping design or tight fit design is a conventional design, which will not be further discussed.

Embodiment 2

Figure 10:
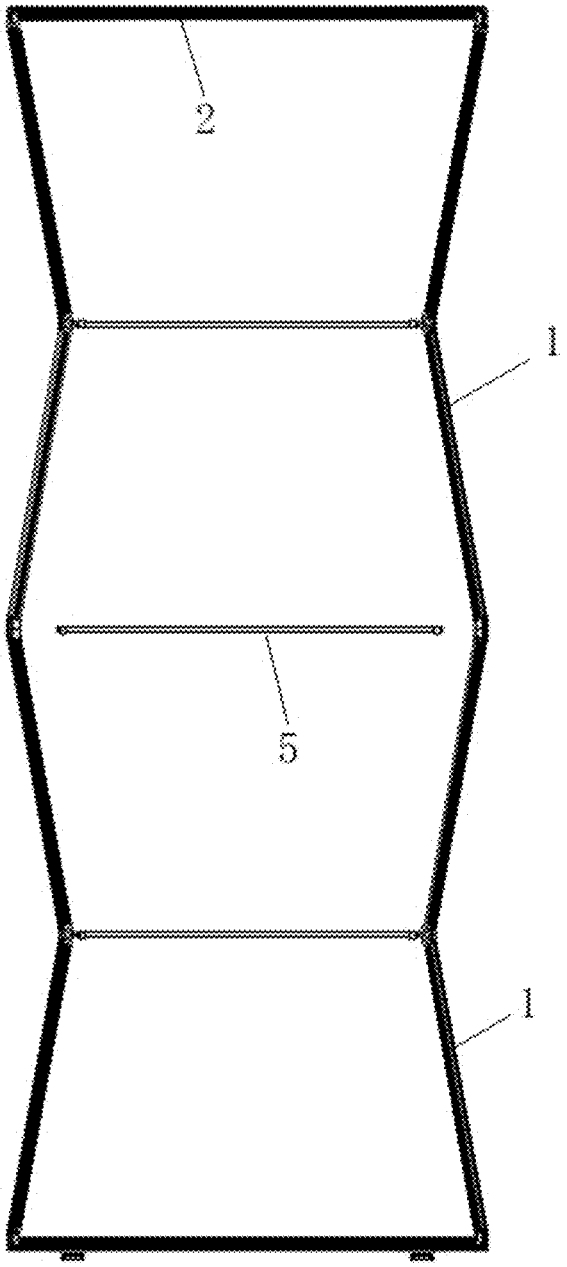
FIG. 10 is a structural diagram of display rack construction according to Embodiment 2.

As shown in FIG. 10, based on Embodiment 1, the folding display rack of this embodiment is longitudinally expanded to include two pairs of long frames 1. An intermediate reverse connection piece 8 is introduced when the folding frame is expanded.

Figure 11:
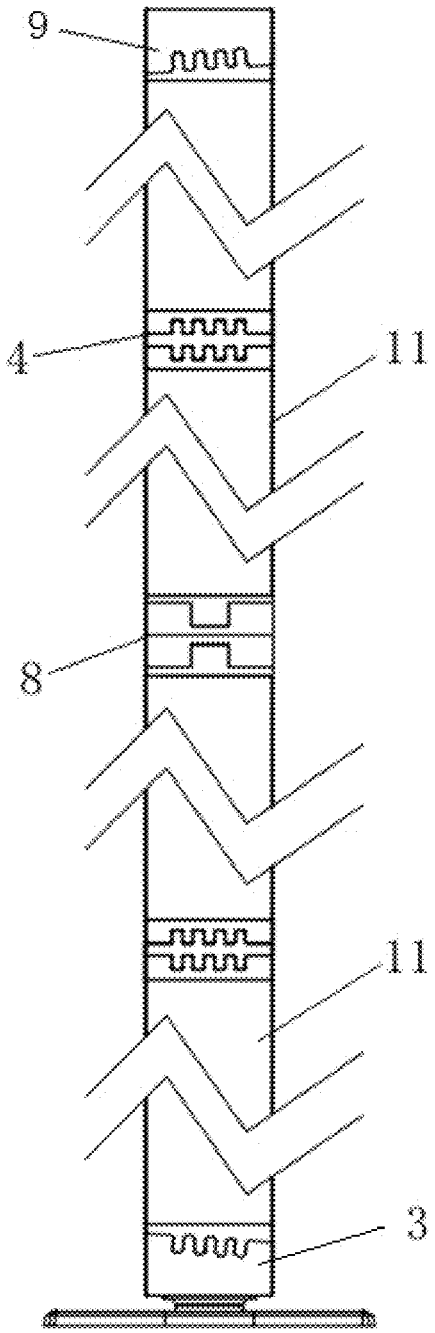
FIG. 11 is a left view of FIG. 8.
Figure 12:
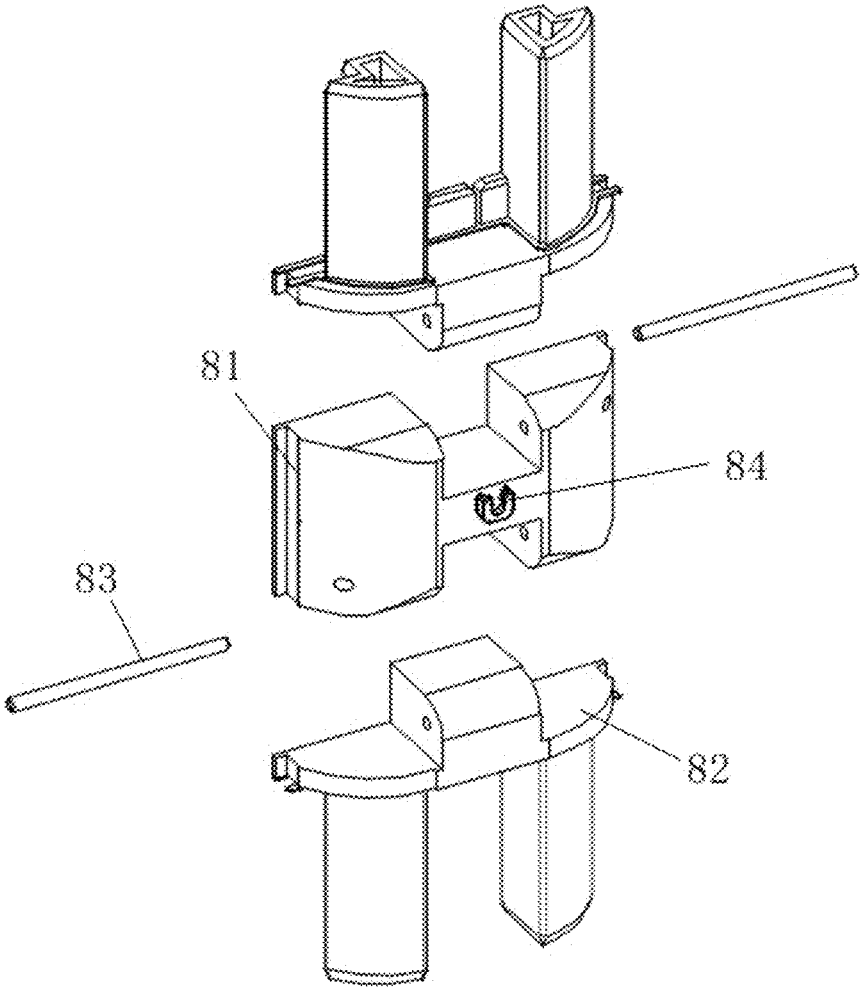
FIG. 12 is an intermediate reverse connection piece.

As shown in FIG. 12: the intermediate reverse connection piece 8 includes an intermediate reverse body 81, and reverse rotation pieces 82 hinged with two ends of the intermediate reverse body respectively through a positioning pin 83; the intermediate reverse body 81 is provided with a clamping notch 84 docked with the supporting rod; and the reverse rotation pieces can rotate around the positioning pin towards the inner side of the display frame, and the rotation direction of the reverse rotation pieces 82 is opposite to the rotation direction of the half-folding piece on the intermediate connection piece 4. As shown in FIG. 11: the intermediate reverse connection piece 8 is of a normal hinged structure, and one end of each of the adjacent long frames 1 on the same side is in inserting connection with the reverse rotation pieces 82, respectively. As shown in FIG. 10 and FIG. 11: the unfolded intermediate reverse connection pieces 8 on the left and right sides are fixedly connected through the supporting rod 5. During folding, the two long frames on the same side are folded towards the inner side of the folding frame, respectively. Finally, the two long frames folded by the intermediate reverse connection piece 8 are superposed together to form a double-layer structure. However, as in Embodiment 1, the frames on two sides are in a mutually staggered structure after being folded.

The intermediate body is provided with a clamping end 43 which is in structure similar to the clamping notch 84 structure arranged on the intermediate reverse body 81.

It can be seen from this embodiment and the figures that according to the present invention, the rapid installment and rapid storage purpose with overall folding and overall unfolding of the folding rack is achieved, greatly meeting the use requirement in the exhibition and display field, and the length of the frames is not limited, achieving use flexibility. In addition, in the present application, the structures of the upper and lower short frames may be different from each other, and can be determined according to the use requirement.

Embodiment 3

Figure 13:
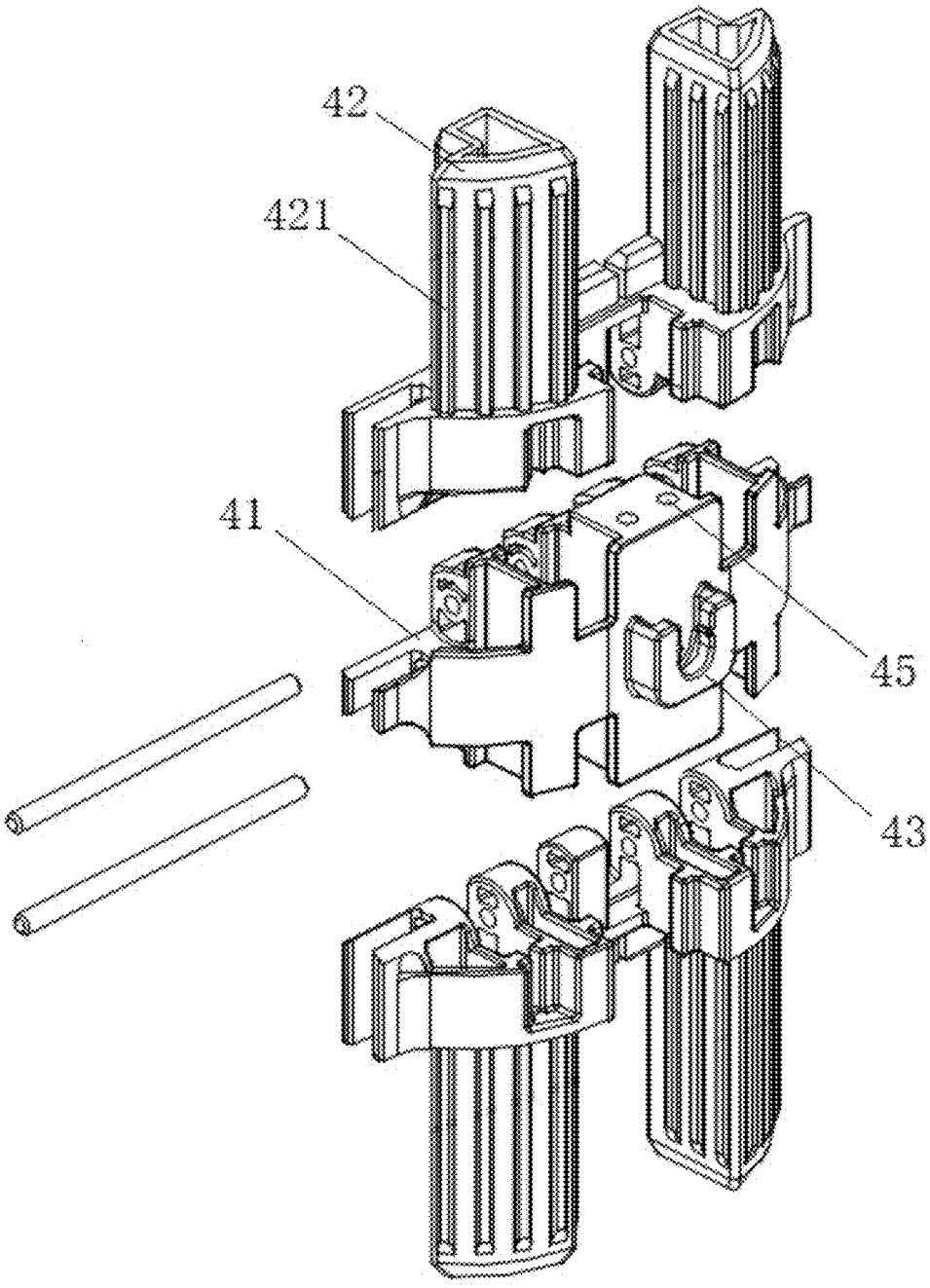
FIG. 13 is a three-dimensional structural diagram of an intermediate connection piece corresponding to Embodiment 3.
Figure 14:
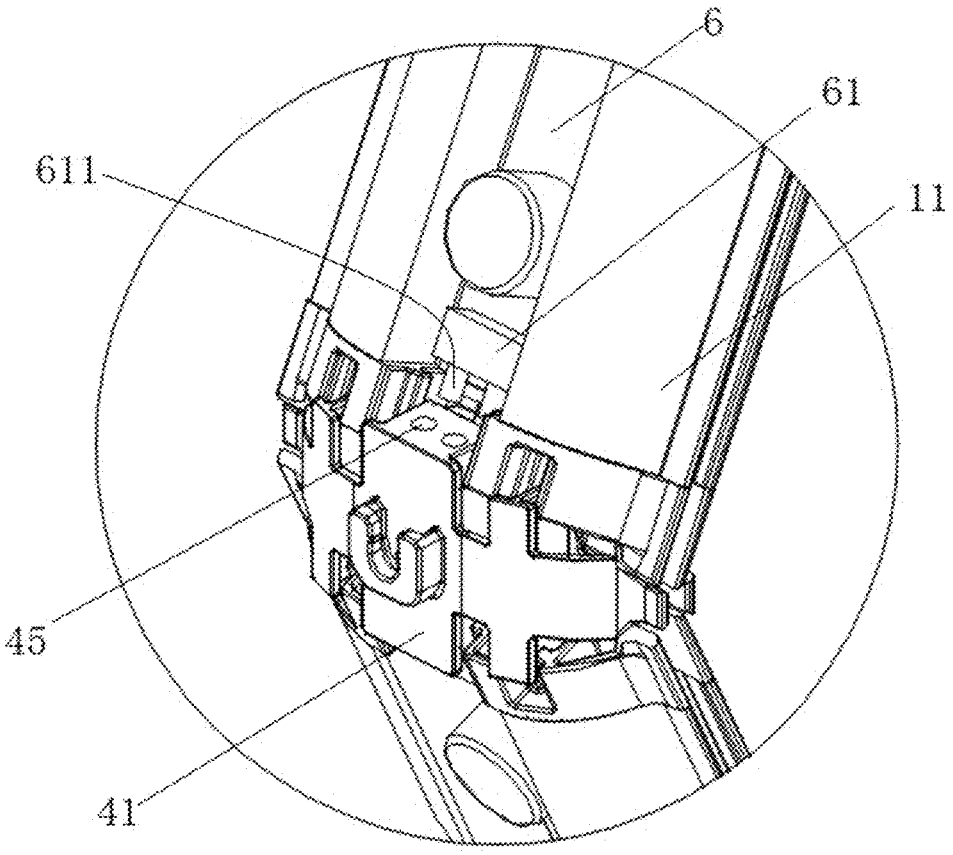
FIG. 14 is a structural diagram of connection of an intermediate connection piece and a long frame corresponding to Embodiment 3.
Figure 15:
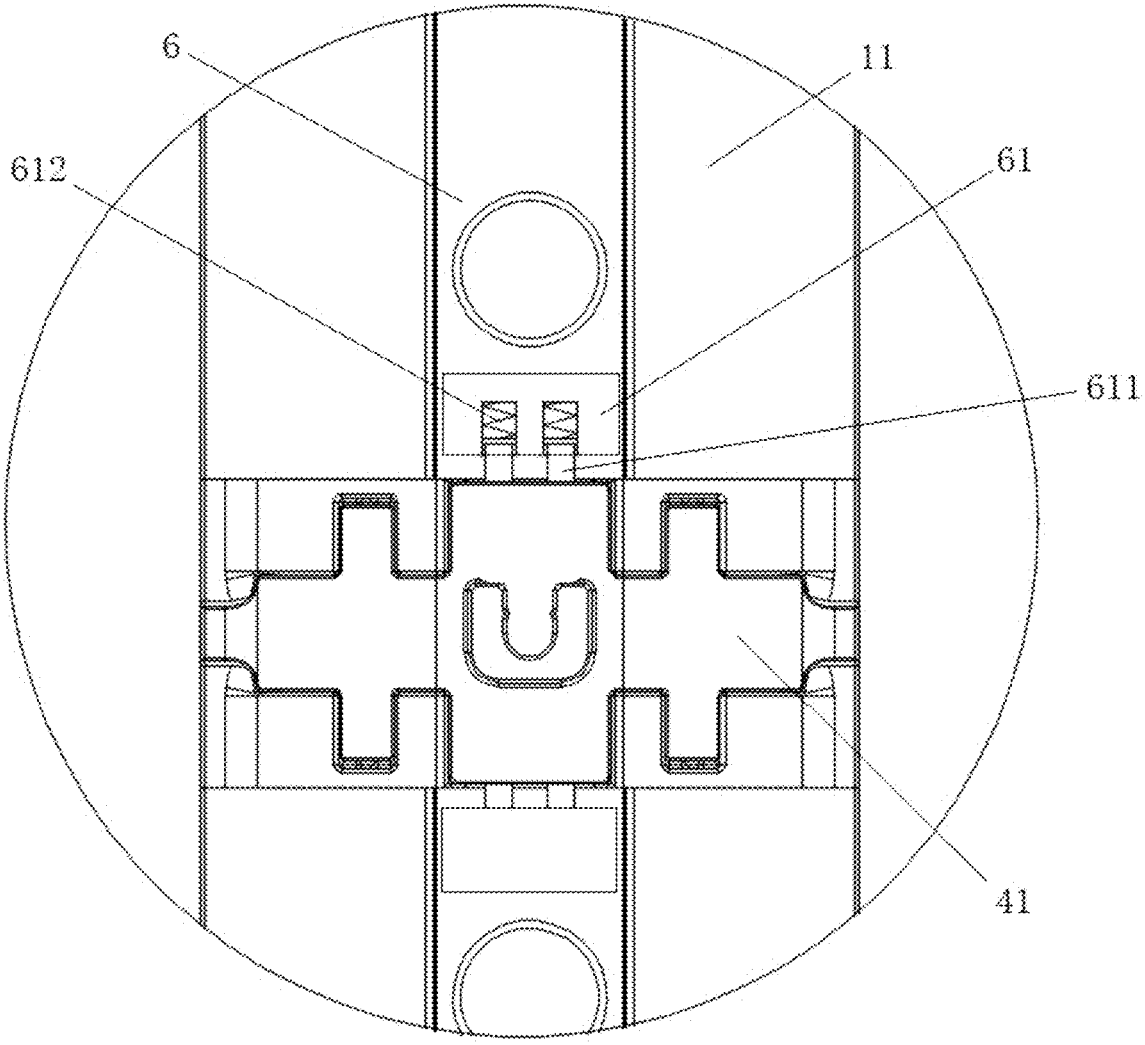
FIG. 15 is a structural diagram of connection of an unfolded intermediate connection piece and a lighting assembly according to Embodiment 3.

As shown in FIG. 13 and FIG. 14, based on Embodiment 1, the folding display rack of this embodiment optimizes the electrified connection structure between the two lighting assemblies in the long frames, so that the two lighting assemblies can achieve an electric series-connection structure after the frames are unfolded. The details are as follows: two conductive columns I 45 penetrating through an intermediate body up and down are fixed on the intermediate body 41 of the intermediate connection piece, and two ends of the conductive columns I 45 slightly exceed the end faces of the two sides of the intermediate body. As shown in FIG. 15: a conductive terminal 61 is arranged on one side of the lighting assembly 6 close to the intermediate connection piece, and two conductive columns 611 extending towards one side of the intermediate connection piece and exceeding the conductive terminal are arranged in the conductive terminal 61 through a spring 612; the conductive columns I 45 and the conductive columns 611 are arranged at the corresponding positions and in contact with each other after the long frames are unfolded; meanwhile, due to the presence of the spring 612, the reliability of contact between the conductive columns I 45 and the conductive columns 611 is ensured. After the folding rack is folded, the conductive columns I are separated from the conductive columns, thereby ensuring the safety between the two lighting assemblies.

In this embodiment, the lighting assemblies fixed in the mounting groove are light strips. In this embodiment, a tensioning strip 421 is further added on the half-folding piece of the intermediate connection piece, thereby ensuring the firmness of connection with the long frame sections 11.

The terms "vertical", "horizontal", "left", "right", "high", "low" and similar expressions used herein are merely for the detailed description of this embodiment and the figures, so that the design ideal of the present application can be understood better.

It is apparent for those skilled in the art that the present invention is not limited to the details of the exemplary embodiments described above. The embodiments should be regarded as exemplary and non-limiting in every respect, and the scope of the present invention is defined by the appended claims rather than the above description. Therefore, it is intended that all changes falling within the meaning and scope of equivalent elements of the claims are included in the present invention. The reference numeral in the claims should not be considered as limiting the involved claims.

What is claimed is:

1. A folding display rack, comprising a display frame, wherein the display frame comprises a pair of short frames and at least one pair of long frames, and the folding display rack further comprises:

a corner connection piece, comprising an upper corner connection piece and a lower corner connection piece, two ends of each long frame are respectively connected to an upper short frame of the pair of short frames and a lower short frame of the pair of short frames through a respective one of the upper corner connection piece and a respective one of the lower corner connection piece; and an intermediate connection piece, the intermediate connection piece is located at a middle position of a respective one of the long frames and divides a respective one of the long frames into two parts, the long frame can be folded in a direction from a middle to an inner side of the display frame through the intermediate connection piece, the long frames on two sides of the display frame can be folded from the middle through the corner connection piece and then are staggered, folded and stored on the lower short frame, wherein the lower corner connection piece comprises a lower corner body, a lower pin shaft and a lower rotation piece, wherein the lower rotation piece is connected to the lower corner body through the lower pin shaft and is rotatable around the lower pin shaft towards the inner side of the display frame, a movable end of the lower rotation piece is in inserting connection with the long frame, wherein with one end of the lower pin shaft as a reference point, another end of the lower pin shaft inclines downwards and towards the inner side of the display frame and is insertion-mounted at a connecting end of the lower corner body and the lower rotation piece, wherein the upper corner connection piece comprises an upper corner body, an upper pin shaft, and an upper rotation piece, and the upper corner connection piece and the lower corner connection piece are respectively mounted at upper and lower ends of the long frame to form an axisymmetric structure.

2. The folding display rack according to claim 1, wherein a downward inclination angle of the lower pin shaft is the same as an inclination angle of the lower pin shaft towards the inner side of the display frame.

3. The folding display rack according to claim 1, wherein the intermediate connection piece comprises an intermediate body and half-folding pieces respectively hinged to two ends of the intermediate body through a pin; and the half-folding pieces are rotatable around the pin towards an outer side of the display frame.

4. The folding display rack according to claim 3, further comprising a supporting rod, two ends of the supporting rod are in clamping connection with the respective intermediate body for limiting a folding after the long frames are unfolded.

5. The folding display rack according to claim 3, wherein two inserting holes are formed in end faces of inner sides of the short frames and the long frames along a length direction, and a mounting groove is formed between the two inserting holes.

6. The folding display rack according to claim 5, wherein a lighting assembly is arranged in the mounting groove.

7. The folding display rack according to claim 1, being provided with intermediate reverse connection pieces and a supporting rod for connecting two or more pairs of the long frames; the intermediate reverse connection piece comprises an intermediate reverse body and reverse rotation pieces respectively hinged to two ends of the intermediate reverse body through a positioning pin, the reverse rotation pieces are rotatable around the positioning pin towards the inner side of the display frame; one end of adjacent long frames of the two or more pairs of long frames on the same side of the display frame is in inserting connection with the reverse rotation pieces, respectively, the intermediate reverse connection pieces at corresponding positions of a left side and a right side of the display frame are connected through the supporting rod for limiting a rotation of the intermediate reverse connection pieces after the display frame is unfolded.

8. The folding display rack according to claim 3, wherein a height of the intermediate body is matched with a height of the long frame folded in half.

9. The folding display rack according to claim 6, wherein a conductive terminal is arranged on one side of the lighting assembly adjacent to the intermediate connection piece, a conductive column extending towards one side of the intermediate connection piece and exceeding the conductive terminal is arranged in the conductive terminal through a spring; a conductive column I penetrating through the intermediate body is fixed on the intermediate body of the intermediate connection piece and at a position corresponding to the conductive column; after the display frame is unfolded, the lighting assemblies on two sides of the intermediate connection piece are electrically connected in series through a contact connection of the conductive column and the conductive column I.

* * * * *